US009048538B2

(12) United States Patent
Sung et al.

(10) Patent No.: US 9,048,538 B2
(45) Date of Patent: Jun. 2, 2015

(54) ANTENNA ASSEMBLY AND WIRELESS COMMUNICATION DEVICE EMPLOYING SAME

(71) Applicants: Kun-Lin Sung, New Taipei (TW); Ting-Chih Tseng, New Taipei (TW); Yen-Hui Lin, New Taipei (TW)

(72) Inventors: Kun-Lin Sung, New Taipei (TW); Ting-Chih Tseng, New Taipei (TW); Yen-Hui Lin, New Taipei (TW)

(73) Assignee: Chi Mei Communication Systems, Inc., New Taipei (TW)

( * ) Notice: Subject to any disclaimer, the term of this patent is extended or adjusted under 35 U.S.C. 154(b) by 145 days.

(21) Appl. No.: 13/650,112

(22) Filed: Oct. 11, 2012

(65) Prior Publication Data

US 2014/0009352 A1 Jan. 9, 2014

(30) Foreign Application Priority Data

Jul. 6, 2012 (TW) ..... 101124421

(51) Int. Cl.

| | |
|---|---|
| ***H01Q 1/24*** | (2006.01) |
| ***H01Q 13/10*** | (2006.01) |
| ***H01Q 21/30*** | (2006.01) |

(52) U.S. Cl.

CPC ..... *H01Q 1/243* (2013.01); *H01Q 13/106* (2013.01); *H01Q 21/30* (2013.01); *H01Q 5/371* (2015.01)

(58) Field of Classification Search

USPC ..... 343/767, 702, 770

See application file for complete search history.

(56) References Cited

U.S. PATENT DOCUMENTS

| | | | | |
|---|---|---|---|---|
| 2010/0245184 | A1* | 9/2010 | Talty et al. | 343/702 |
| 2012/0326936 | A1* | 12/2012 | Tu | 343/767 |

* cited by examiner

*Primary Examiner* — Dieu H Duong

(74) *Attorney, Agent, or Firm* — Novak Druce Connolly Bove + Quigg LLP

(57) ABSTRACT

A wireless communication device includes a housing and an antenna assembly. The antenna assembly includes a base board, a feed member electronically connecting with the base board to carry an electrical current, and a radio member including a first radio portion, the first radio portion defining a first slot. The radiator couples with the feed member, inducing an electrical current in the first radio portion. The radio member is electronically connected to the base board through the metal housing, enabling the induced electrical current to flow through the first radio portion, the metal housing, and the base board to form a current loop. The induced electrical current flows through the first slot to excite a first resonance mode, enabling the antenna assembly to receive/transmit a first wireless signal.

17 Claims, 4 Drawing Sheets

ANTENNA ASSEMBLY AND WIRELESS COMMUNICATION DEVICE EMPLOYING SAME

BACKGROUND

1. Technical Field

The present disclosure relates to antenna assemblies and wireless communication devices employing the antenna assemblies.

2. Description of Related Art

Antennas are important elements of wireless communication devices (such as mobile phones). Many wireless communication devices employ metal housings. The metal housings are in contact with mainboards of the wireless communication devices and form large grounding points, thus reducing a radiation efficiency of the antennas. So, antennas in wireless communication devices employing metal housings achieve a less than optimal radiation efficiency of the antennas.

Therefore, there is room for improvement within the art.

BRIEF DESCRIPTION OF THE DRAWINGS

Many aspects of the disclosure can be better understood with reference to the drawings. The components in the drawings are not necessarily drawn to scale, the emphasis instead being placed upon clearly illustrating the principles of the disclosure. Moreover, in the drawings, like reference numerals designate corresponding parts throughout the views.

DETAILED DESCRIPTION

Figure 1:
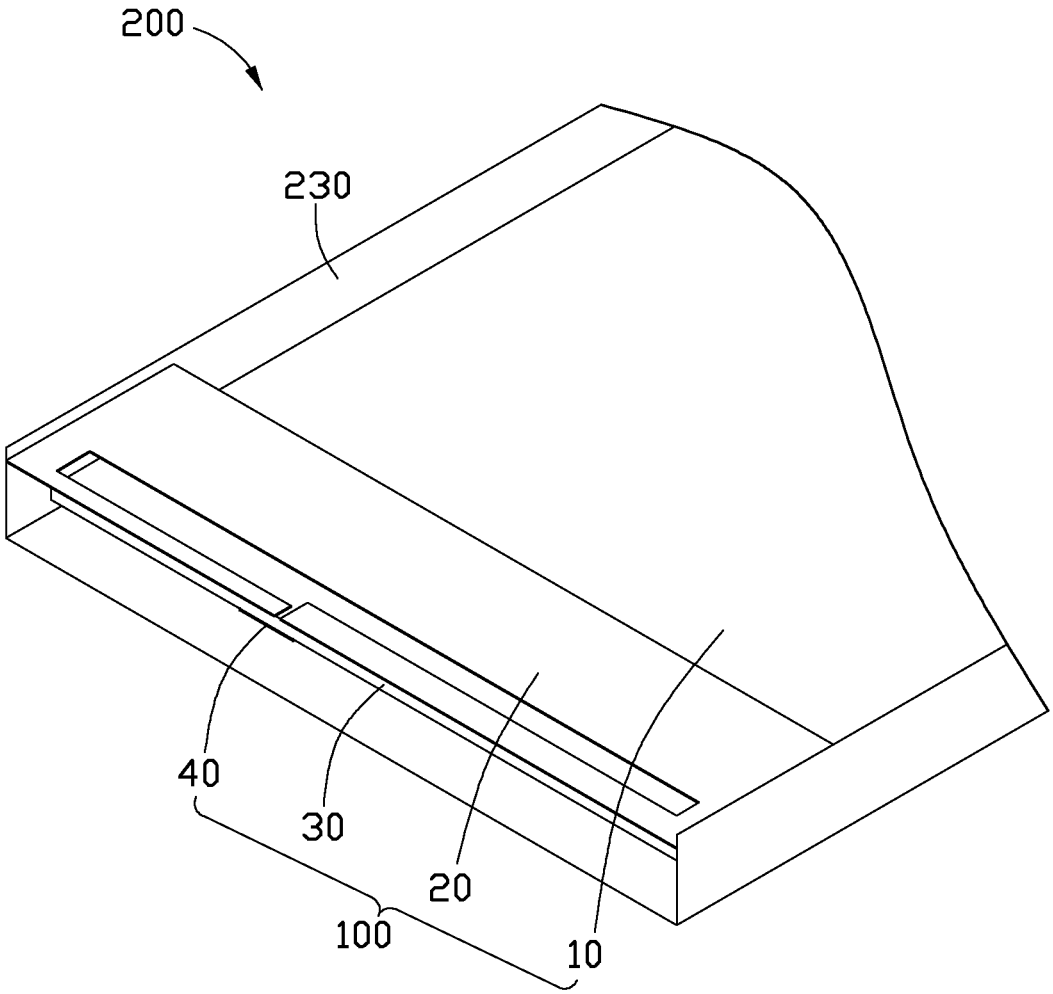
FIG. 1 is a partial isometric view of a wireless communication device employing an antenna assembly in accordance with an exemplary embodiment.
Figure 2:
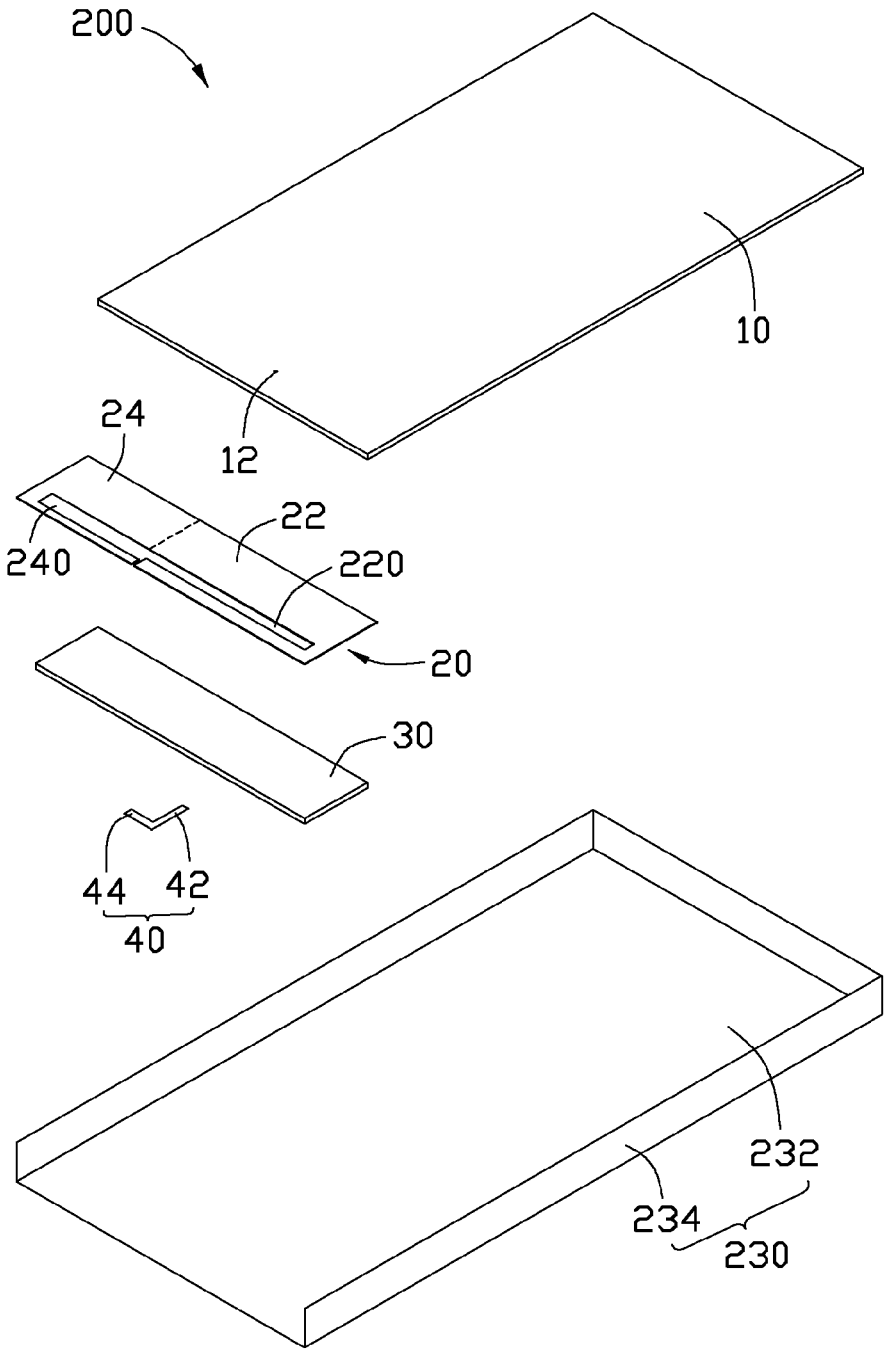
FIG. 2 is an exploded view of the wireless communication device of FIG. 1.

FIG. 1 and FIG. 2 show an exemplary embodiment of a wireless communication device 200 employing an antenna assembly 100. The wireless communication device 200 may be a mobile phone or a personal digital assistant or the like. The wireless communication device 200 includes a housing 230 and a plurality of electronic elements (not shown). The housing 230 is made of an electrically conductive material, such as metal. The housing 230 includes a bottom wall 232 and two sidewalls 234 opposite to each other and connecting with two ends of the bottom wall 232. The bottom wall 232 and the two sidewalls 234 cooperatively surround a receiving space (not shown) for receiving the antenna assembly 100 and the electronic elements. In the exemplary embodiment, the electronic elements include a touch screen, but the disclosure is not limited thereto.

The antenna assembly 100 includes a base board 10, a radio member 20, a supporting member 30, and a feed member 40.

In the exemplary embodiment, the base board 10 is a printed circuit board (PCB) of the wireless communication device 200 made of composite material composed of woven fiberglass cloth with an epoxy resin binder. The base board 10 has a feed point 12 that feeds current to the antenna assembly 100. In assembly, the base board 10 is electronically connected to the sidewalls 234 of the housing 230, thus the antenna assembly 100 is grounded through the sidewalls 234.

Figure 3:
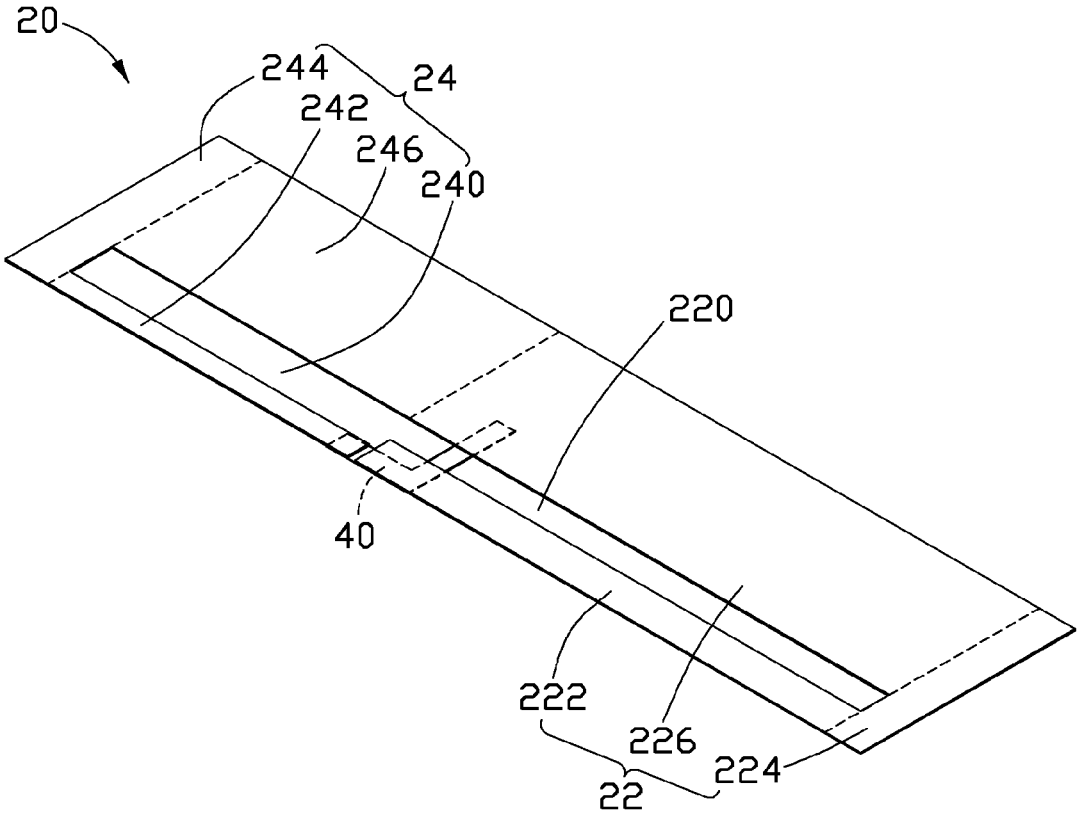
FIG. 3 is a plan view of a radio member of the antenna assembly shown in FIG. 1.

In the exemplary embodiment, the radio member 20 is positioned beneath the touch screen and supported by the supporting member 30. Referring to FIG. 3, the radio member 20 is a planar sheet including a first radio portion 22 and a second radio portion 24 coplanar with the first radio portion 22. An end of the first radio portion 22 connects with an end of the second radio portion 24, another end of the first radio portion 22 is opposing and in close proximity to another end of the second radio portion 24. The first radio portion 22 and the second radio portion 24 can be used to receive and transmit wireless signals having different working frequencies.

The first radio portion 22 defines a first slot 220 and includes a first portion 222, a second portion 224, and a third portion 226. The first portion 222 is parallel to and spaced from the third portion 226 by the first slot 220. Length of the first portion 222 is substantially equal to length of the third portion 226. Width of the first portion 222 is less than width of the third portion 226. The second portion 224 is perpendicular to the first and third portions 222, 226 and connects with an end of each of the first and third portions 222, 226, thereby closing an end of the first slot 220. In assembly, the second portion 224 is electronically connected to one of the sidewalls 234, thus the second portion 224 is electronically connected to the base board 10 through the sidewall 234. In the exemplary embodiment, the first slot 220 has a width of about 2 mm. The first radio portion 22 can be used to effectively receive and transmit a first wireless signal having a central frequency of about 1570-1575 MHz (such as a GPS signal).

The second radio portion 24 defines a second slot 240 and includes a first section 242, a second section 244, and a third section 246. The second slot 240 communicates with the first slot 220. The first section 242 is spaced from the first portion 222 with an end of the first section 242 opposite to an end of the first portion 222. In the exemplary embodiment, the small space between the first section 242 and the first portion 222 is about 0.5 mm. The first section 242 is parallel to and spaced from the third section 246 by the second slot 240. The length of the first section 242 is substantially equal to the length of the third section 246. The width of the first section 242 is less than the width of the third section 246. The second section 244 is perpendicular to the first and third sections 242, 246 and connects with an end of each of the first and third sections 242, 246, thereby closing an end of the second slot 240. In assembly, the second section 244 is electronically connected to the other sidewall 234, thus the second section 244 is electronically connected to the base board 10 through the sidewall 234. The third section 246 connects with the third portion 226 and has a width substantially equal to the width of the third portion 226. In the exemplary embodiment, the second slot 240 has a width of about 3 mm. The second radio portion 24 can be used to effectively receive and transmit a second wireless signal having a central frequency of about 2400-2484 MHz (such as a WIFI signal).

The supporting member 30 is located between the radio member 20 and the bottom wall 232 of the housing 230. The supporting member 30 supports the radio member 20. In the exemplary embodiment, the supporting member 30 is a flexible circuit board.

The feed member 40 is located between the supporting member 30 and the bottom wall 232. The feed member 40 is positioned beneath the supporting member 30 and is spaced from the radio member 20 by a distance of about 0.4 mm. In the exemplary embodiment, the feed member 40 is substantially an L-shaped micro-strip having a first feed portion 42 and a second feed portion 44. The first feed portion 42 is located beneath an end of the first radio portion 22 near the second radio portion 24 and bridges (or crosses over) the first slot 220 to extend to and beyond an edge portion of the first portion 222. An end of the first feed portion 42 is electronically connected to the feed point 12 of the base board 10 to carry an electrical current. The second feed portion 44 extends perpendicularly from another end of the first feed portion 42 and bridges (or crosses over) the space between the first portion 222 and the first section 242.

The operating principle of the antenna assembly 100 is as follows.

Figure 4:
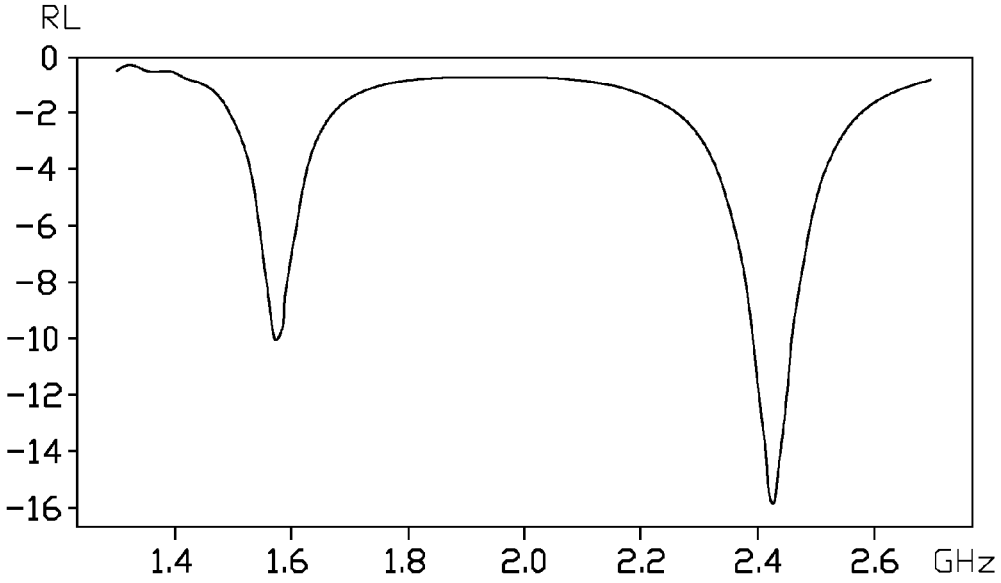
FIG. 4 is a diagram of measuring a return loss (RL) of the antenna assembly shown in FIG. 1, in two different working frequency bands.

When electrical current is fed into the feed member 40 from the feed point 12, the feed member 40 couples with the radio member 20, inducing an electrical current in both the first radio portion 22 and the second radio portion 24. The induced electrical current in the first radio portion 22 is conducted from the first portion 222, the third portion 226, and the first slot 220 to the second portion 224 and is then conducted by the sidewall 234 to the base board 10 to form a current loop. The current strength around the first slot 220 is greater than around other regions of the first radio portion 22, enabling the first radio portion 22 to excite a first resonance mode to receive and transmit the first wireless signal. The induced electrical current in the second radio portion 24 is conducted from the first section 242, the third section 246, and the second slot 240 to the second section 244 and then conducted by the sidewall 234 to the base board 10 to form a current loop. The current strength around the first slot 240 is greater than around other regions of the second radio portion 24, enabling the second radio portion 24 to excite a second resonance mode to receive and transmit the second wireless signal. FIG. 4 shows that when the antenna assembly 100 is used to receive and transmit wireless communication signals in central frequencies of 1570-1575 MHz and 2400-2484 MHz, the antenna assembly 100 has wide bandwidths and a high receiving and transmitting efficiency.

If the antenna assembly 100 is used to receive or transmit only one kind of wireless communication signal, one of the first and the second radio portions 22, 24 can be omitted. In that case, the corresponding first or second slots 220, 240 can be omitted.

It is to be understood, however, that even through numerous characteristics and advantages of the present disclosure have been set forth in the foregoing description, together with details of assembly and function, the disclosure is illustrative only, and changes may be made in detail, especially in the matters of shape, size, and arrangement of parts within the principles of the disclosure to the full extent indicated by the broad general meaning of the terms in which the appended claims are expressed.

What is claimed is:

1. A wireless communication device, comprising:

a housing; and an antenna assembly, comprising:

a base board;

a feed member electronically connected to the base board to carry an electrical current; and a radio member including a first radio portion and a second radio portion, the first radio portion defining a first slot;

wherein the feed member comprises a first feed portion and a second feed portion, the first feed portion bridges the first slot, the second feed portion extends perpendicularly from an end of the first feed portion and bridges a space between the first radio portion and the second radio portion; and wherein the radio member couples with the feed member, inducing an electrical current in the first radio portion; the housing is electronically connected to the radio member and the base board; the electrical current induced by the first radio portion flows through the first radio portion, the housing, and the base board to form a current loop; the electrical current induced by the first radio portion flows through the first slot to excite a first resonance mode, enabling the antenna assembly to receive and transmit a first wireless signal.

2. The wireless communication device as claimed in claim 1, wherein the first radio portion includes a first portion, a second portion, and a third portion; the first portion is parallel to and spaced from the third portion by the first slot; the second portion is perpendicular to the first and third portions and connects with an end of each of the first and third portions, thereby closing an end of the first slot.

3. The wireless communication device as claimed in claim 2, wherein the second radio portion defines a second slot; the second radio portion induce an electrical current; the electrical current induced by the second radio portion flows through the second radio portion, the housing, and the base board to form a current loop; the electrical current induced by the second radio portion flows through the second slot, enabling the second radio portion to excite a second resonance mode to receive and transmit the second wireless signal.

4. The wireless communication device as claimed in claim 3, wherein the second radio portion includes a first section, a second section, and a third section; the first section is parallel to and spaced from the third section by the second slot; the second section is perpendicular to the first and third sections and connects with an end of each of the first and third sections, thereby closing an end of the second slot.

5. The wireless communication device as claimed in claim 4, wherein the first slot communicates with the second slot; the first section is spaced from the first portion; the third section connects with the third portion.

6. The wireless communication device as claimed in claim 5, wherein the housing is made of an electrically conductive material.

7. The wireless communication device as claimed in claim 6, further comprising a supporting member supporting the radio member, wherein the feed member is located between the supporting member and the bottom wall.

8. The wireless communication device as claimed in claim 5, wherein the housing includes a bottom wall and two sidewalls opposite to each other and connecting with two ends of the bottom wall; each of the second portion and the second section is electronically connected to the base board through one of the sidewalls.

9. The wireless communication device as claimed in claim 5, wherein the first feed portion is located beneath an end of the first radio portion near the second radio portion, and the second feed portion bridges a space between the first portion and the first section.

10. An antenna assembly employed by a wireless communication device having a metal housing, the antenna assembly comprising:

a base board;

a feed member electronically connecting with the base board to obtain an electrical current; and a radio member including a first radio portion and a second radio portion, the first radio portion defining a first slot;

wherein the feed member comprises a first feed portion and a second feed portion, the first feed portion bridges the first slot, the second feed portion extends perpendicularly from an end of the first feed portion and bridges a space between the first radio portion and the second radio portion; and wherein the radio member couples with the feed member, inducing an electrical current in the first radio portion; the radio member is electronically connected to the base board through the metal housing, enabling the electrical current induced by the first radio portion to flow through the first radio portion, the metal housing, and the base board to form a current loop; the electrical current induced by the first radio portion flows through the first slot to excite a first resonance mode, enabling the antenna assembly to receive and transmit a first wireless signal.

11. The antenna assembly as claimed in claim 10, wherein the first radio portion includes a first portion, a second portion, and a third portion; the first portion is parallel to and spaced from the third portion by the first slot; the second portion is perpendicular to the first and third portions and connects with an end of each of the first and third portions, thereby closing an end of the first slot.

12. The antenna assembly as claimed in claim 11, wherein the second radio portion defines a second slot; the second radio portion induces an electrical current; the electrical current induced by the second radio portion flows through the second radio portion; the housing, and the base board to form a current loop; the electrical current induced by the second radio portion flows through the second slot to excite a second resonance mode, enabling the antenna assembly to receive/transmit a second wireless signal.

13. The antenna assembly as claimed in claim 12, wherein the second radio portion includes a first section, a second section, and a third section; the first section is parallel to and spaced from the third section by the second slot; the second section is perpendicular to the first and third sections and connects with an end of each of the first and third sections, thereby closing an end of the second slot.

14. The antenna assembly as claimed in claim 13, wherein the first slot communicates with the second slot; the first section is spaced from the first portion; the third section connects with the third portion.

15. The antenna assembly as claimed in claim 14, wherein the first feed portion is located beneath an end of the first radio portion near the second radio portion, and the second feed portion bridges a space between the first portion and the first section.

16. The antenna assembly as claimed in claim 13, wherein the metal housing comprises a bottom wall and two sidewalls opposite to each other and connecting with two ends of the bottom wall; each of the second portion and the second section is electronically connected to the base board through one of the sidewalls.

17. The antenna assembly as claimed in claim 16, further comprising a supporting member supporting the radio member, wherein the feed member is located between the supporting member and the bottom wall.

* * * * *